US007452011B1

(12) United States Patent
Lind

(10) Patent No.: US 7,452,011 B1
(45) Date of Patent: Nov. 18, 2008

(54) SAFETY LATCH APPARATUS

(76) Inventor: Eric Lind, 1010 E. Loma Vista, Tempe, AZ (US) 85282

( * ) Notice: Subject to any disclaimer, the term of this patent is extended or adjusted under 35 U.S.C. 154(b) by 0 days.

(21) Appl. No.: 11/530,801

(22) Filed: Sep. 11, 2006

(51) Int. Cl.
*E05C 19/06* (2006.01)

(52) U.S. Cl. ..... 292/87; 292/298

(58) Field of Classification Search ..... 292/80, 292/87, 91, 297, 298, 353
See application file for complete search history.

(56) References Cited

U.S. PATENT DOCUMENTS

| | | | | |
|---|---|---|---|---|
| 3,924,886 | A | 12/1975 | Markovitch | |
| 4,062,578 | A | 12/1977 | Chen | |
| 4,068,872 | A * | 1/1978 | Smith | 292/87 |
| 4,134,608 | A | 1/1979 | Pool | |
| 4,357,038 | A | 11/1982 | Westerlund | |
| 4,378,948 | A | 4/1983 | Chrones | |
| 4,408,789 | A | 10/1983 | Miller | |
| 4,416,477 | A | 11/1983 | Bialobrzeski et al. | |
| 4,475,753 | A | 10/1984 | D'Ath | |
| 4,714,284 | A | 12/1987 | Varlet | |
| 4,717,184 | A | 1/1988 | Boyce | |
| 5,445,451 | A * | 8/1995 | Harmony | 312/333 |
| 5,626,372 | A * | 5/1997 | Vogt | 292/87 |
| 5,711,554 | A | 1/1998 | Brown et al. | |
| 5,865,480 | A | 2/1999 | Bain, Jr. et al. | |
| 6,481,811 | B1 * | 11/2002 | Marsh | 312/333 |
| 6,604,764 | B2 * | 8/2003 | Zemzik | 292/293 |
| 6,874,198 | B2 | 4/2005 | Renaud | |
| 6,932,392 | B1 | 8/2005 | Geislhardt | |
| 6,942,257 | B2 * | 9/2005 | Wong et al. | 292/128 |
| 2005/0199025 | A1 | 9/2005 | West | |

* cited by examiner

*Primary Examiner*—Gary Estremsky
(74) *Attorney, Agent, or Firm*—Schmeiser Olsen & Watts LLP

(57) ABSTRACT

A safety latch apparatus for retaining a swinging door in a substantially closed position relative to a door frame comprising a receiving assembly having a base portion for mounting to the swinging door or door frame and a single receiving element protruding from said base portion; and a latching assembly engageable with said receiving element and a finger protector. The latching assembly comprising: a biased or curved compliant arm having a hook element coupled at the end, wherein said receiving element engages said hook element at a single point; and a latching assembly mounting mechanism for mounting said complaint arm to said door or door frame such that the receiving assembly and latching assembly are mounted on cooperating doors and door frames. The latching assembly mounting mechanism further comprising an arm retaining plate, and an arm cover plate. The compliant arm also being mountable without a latching assembly mounting mechanism.

20 Claims, 14 Drawing Sheets

SAFETY LATCH APPARATUS

BACKGROUND OF THE INVENTION

1. Technical Field

This invention relates to safety latches, and more specifically to biased safety latches that secure a door without positive user engagement.

2. Background Art

A door is generally an opening in a wall (or other partition), often equipped with a hinge and which can be moved to leave the opening accessible, or to close it more or less securely. Hinged doors have typically been the predominant type of door used within homes, businesses, or other structures for egress/regress between various rooms or even the outside of a structure. Doors are used in structures of all kinds, allowing passage between inside and outside, or among internal rooms. The purpose of a door opening is to allow people, animals, and objects to pass, as well as for ventilation. The purpose of door closure is to prevent passage of air, reduce air drafts, create an enclosed space that can be heated or cooled more effectively, privacy and noise reduction, and to help prevent the spread of fire.

Limiting passage between areas partitioned by doors has historically been controlled by latches or locks. When a partitioned area contains a hazard, danger, or vulnerability, a latch or lock may secure the door against passage by an unauthorized person or animal. For example, a latch may be used to prevent a child's access to a home office or prevent a pet from entering an off-limits area. Similarly, when a person desires privacy within a specific unit of a structure, a latch or lock may be engaged to prevent passage of other people occupying the same structure. Latches and locks have been traditionally located midway between the top and bottom of a standard door allowing individual users of varying heights access to the device and effectively access to the room. Such placement of latches enables children to also disengage the latch and pass through a door. Furthermore, some doors are not necessarily latched when in closed but unlocked positions and may be opened merely by applying pressure to any surface of the door and pushing. Thus, their effectiveness in preventing children and pets from passing through the door may be limited. Because of dangers lying beyond a door, or because of desires to limit the access of children and pets to certain units, access limiting devices have been developed and are known in the art. Commonly known devices used on swinging doors include free-spinning door knob covers and security chains mounted out of reach of children.

Regrettably, many access limiting devices become a hassle for adults to operate because of the additional access limitations they create for adult users. When such devices become obstructive to adults, such devices are frequently disengaged or bypassed, thus eliminating their beneficial use. An example of such an obstruction is an engaged security chain mounted on the interior of a door that may effectively limit the travel of the door when a child attempts to open it. However, the engaged safety chain on the interior of the door prohibits an adult user of the door from entering from the exterior side. Many other access limiting devices are only overrideable from one side of the door and equally become a nuisance to an adult user.

Another nuisance for adults, which exists in many safety latch devices, is required positive user interaction to engage the latching mechanism. This positive interaction requirement may limit protection compared to systems that lock automatically when the door closes. For example, a child, the infirmed or pet may be put in danger when a parent or guardian simply forgets to latch a door to a foreseeably dangerous area.

The prior art contemplates numerous safety latches. The prior art, however, suffers from flaws not present in the current invention. Several latches exist, such as chain latches and the like, that require user assistance to engage the latch. Most latches, however, mount to the molding surrounding a door and therefore any force applied to the latch pulls on the nails mounting the molding. This significantly weakens the strength of the latches. Many latches, also, simply are not overrideable from both sides of a door, and require time and effort to effectively put them to use. Similarly, most safety latches do not comprise a biased locking feature that enables automatic locking without user input, while those that do comprise a bias feature suffer from inconsistency in latch engagement. Almost all latches on the market today lack the ability to mount to doors with various shapes of molding surrounding them. Lastly, the prior art safety latches lack the ability to grant to a user the power to adjust the latch to allow a door to open only to a desired displacement. It is desirable therefore, to have a safety latch device that comprises the following features: a latch that is predisposed to a latchable position and automatically engages when a user attempts to open a door, a latch that is overrideable from either side of a door, a latch that is biased to automatically return to a latchable position after overridden, a latch that will mount to a door regardless of the shape of the molding surrounding the door, a latch that is easy to install and use, a device that is adjustable to allow a door to open to various pre-determined angular displacements, a latch that is disengageable thus allowing a door to open and close freely, a latch that mounts to the door frame rather than the molding surrounding a door, a latch with a finger protector to keep fingers from being smashed in the door, and a latch that is installable on either side of a door and at a variety of vertical positions on a door and doorframe. Prior inventions contemplate devices with some of these features, but none disclose a device capable of all of the listed features. Accordingly, what is needed is a door safety latch capable of all of these features.

DISCLOSURE OF THE INVENTION

The safety latch apparatus of this invention has several features, no single one of which is solely responsible for its desirable attributes. Without limiting the scope of this invention as expressed by the claims that follow, its more prominent features will now be discussed briefly. The present invention provides an apparatus for retaining a movable member, such as a door, of an opening in a closed or substantially closed position relative to a fixed position member, such as a frame of an opening. The safety latch comprises a receiving assembly comprising a single receiving element and a mountable base portion. The safety latch further comprises a latching assembly, engageable with said receiving assembly, comprising a biased compliant arm having a catch element coupled at the end thereof for engaging with said receiving element. The biased compliant arm may be curved to predispose the hook element to engage the receiving element when the opening is utilized. The safety latch is overridable from both sides of an opening by deflecting the compliant arm, after which the biased compliant arm will return to its original latchable position. From the interior of an opening, a user may employ an interactive portion of the latching element for deflecting the latching assembly away from the receiving element. From the exterior of an opening, a user may directly push the compliant arm away from the receiving element.

Upon sufficient deflection of the compliant arm, a user may then open the door and bypass engagement of the latch. The safety latch may also easily and quickly be temporarily or permanently disengaged by removing the entire latching assembly or removing the latching element. Disengagement of the latch by removal of the latching assembly is enabled by use of the mounting mechanism feature of this invention, or by simply uninstalling the latching assembly. Disengagement of the latch by removal of the latching element may be enabled by a slideable and lockable latching element that may be slid off the compliant arm thereby effectively preventing the latching function. This slideable latching element feature also may allow a user to pre-select the desired distance a movable member will be allowed to open before latch engagement.

The safety latch apparatus of this invention may comprise the following features: the latch may be predisposed to a latching position and automatically engages when an unauthorized user attempts to open a door; the latch may be overrideable from either side of a door; the latch may be mountable on any door regardless of the shape of the molding surrounding the door, the latch may be biased to automatically return to a latchable position after overridden; the latch may be easy to install and use; the latch may be adjustable to allow a door to open to various pre-determined angular displacements; the latch may be disengageable thus allowing for a door to open and close freely; the latch may comprise a finger protector which prevents fingers from being smashed in a door; and the latch may be installable on either side of a door and at a variety of vertical positions on a door and doorframe The foregoing and other features and advantages of the invention will be apparent to those of ordinary skill in the art from the following more particular description of the invention and the accompanying drawing.

BRIEF DESCRIPTION OF THE DRAWINGS

The invention will hereinafter be described in conjunction with the appended drawings where like designations denote like elements, and.

DESCRIPTION OF THE PREFERRED EMBODIMENTS

Figure 1:
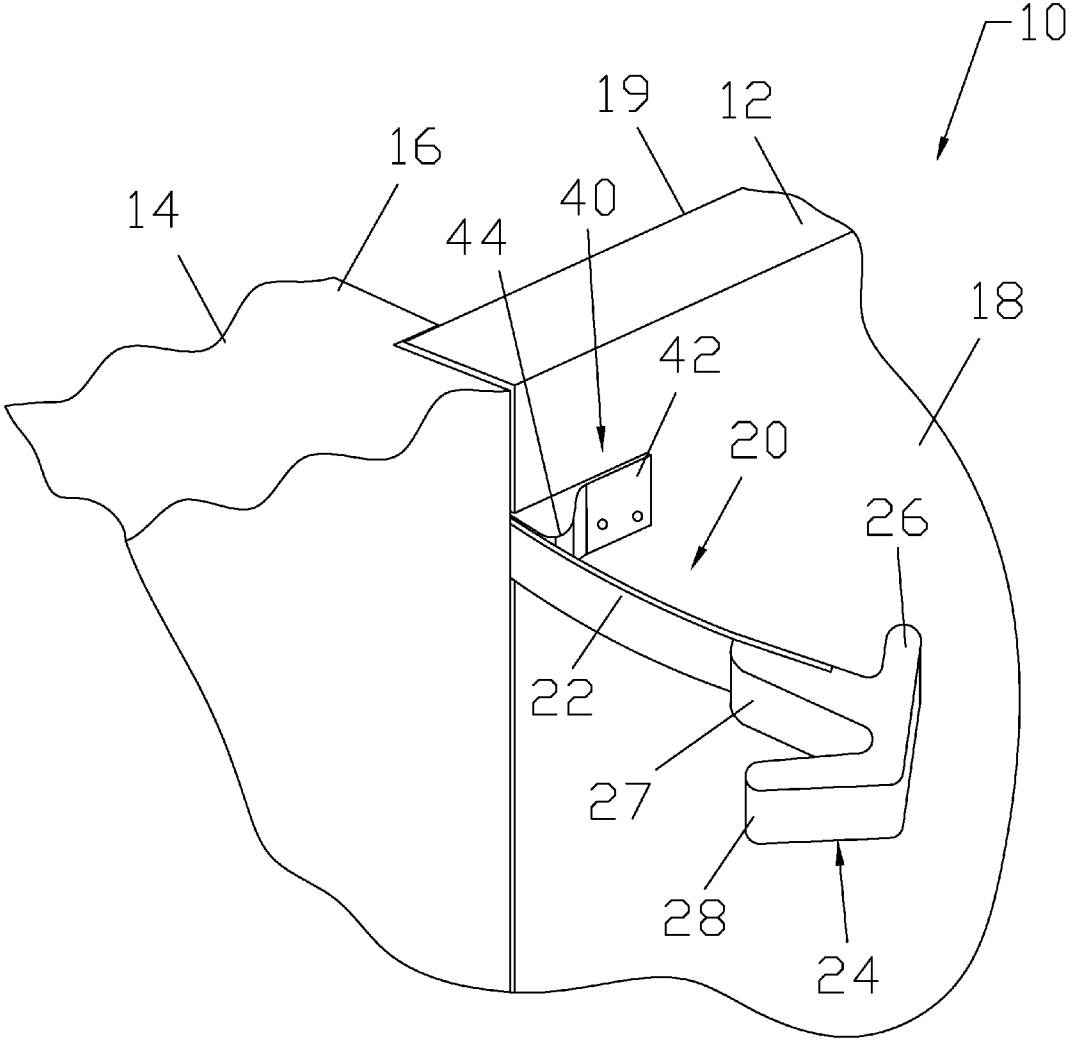
FIG. 1 is a perspective view of a safety latch apparatus configured according to an embodiment of the present invention coupled to a closed door unit.

As discussed above, embodiments of the present invention relate to a safety latch apparatus. Various embodiments of the invention are shown throughout the figures. The figures include common elements in different structural configurations. Common elements are designated with a common base numeral.

Referring generally to FIGS. 1-5, a safety latch apparatus 10 is depicted for maintaining a swinging door 12 in a substantially closed position relative to a door frame 14, wherein said safety latch apparatus 10 comprises a latching assembly 20 and a receiving assembly 40. Maintaining a swinging door 12 in a substantially closed position may be facilitated by engagement of said latching assembly 20 and said receiving assembly 40. While a swinging door 12 is depicted in the drawings, it is contemplated that the safety latch apparatus 10 may be modified to function on any opening assembly comprising a fixed position member and a movable member. Opening assemblies may include gates, double doors where one of the doors is in a fixed position and the other door is movable, sliding doors, cupboard doors, refrigerator/freezer doors, and the like. The safety latch apparatus 10 is designed to prevent children, pets, the infirmed or visitors (unauthorized users) from opening a latch equipped opening, while allowing adults (authorized users) the ability to bypass the latching function of the safety latch apparatus 10.

Figure 6B:
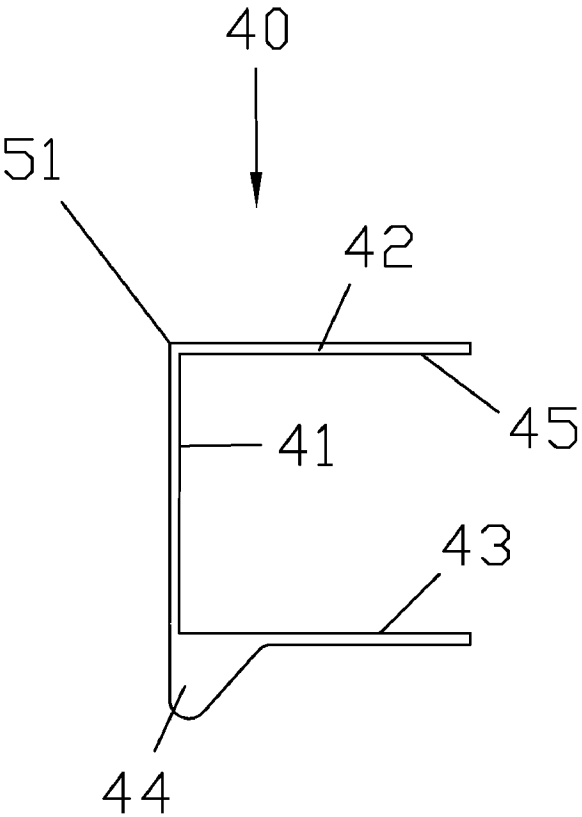
FIG. 6B is a top view of a receiving assembly configured according to an embodiment of the present invention.
Figure 6A:
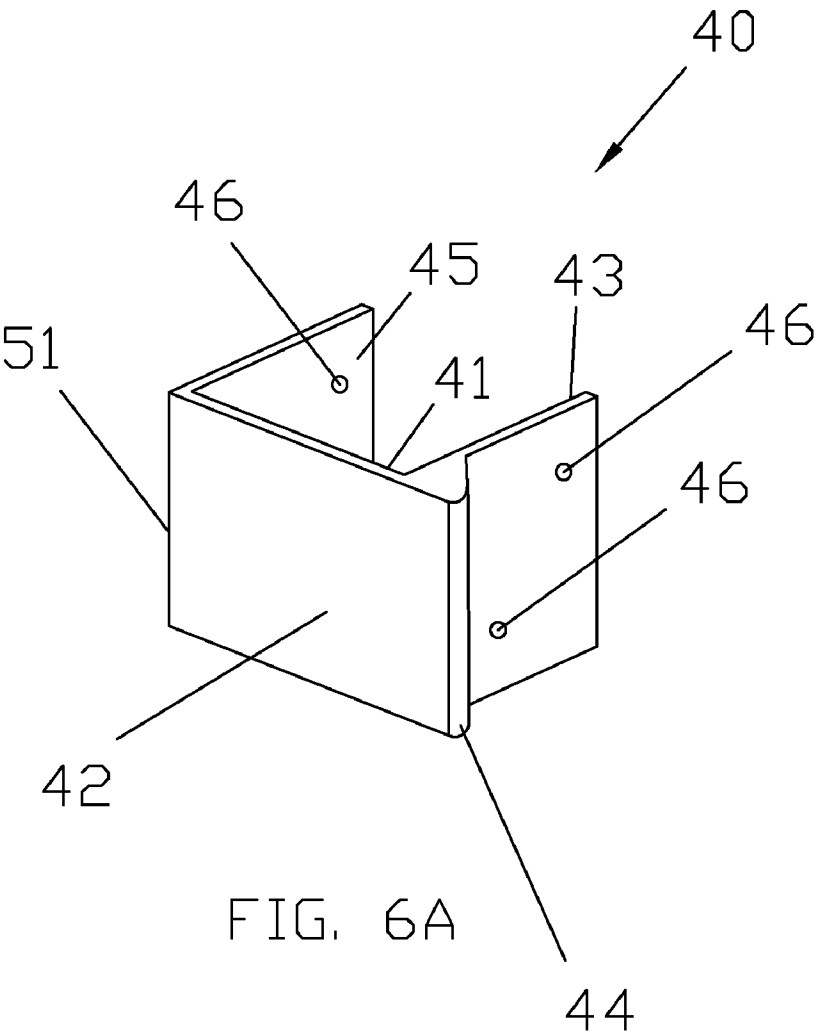
FIG. 6A is a perspective view of a receiving assembly configured according to an embodiment of the present invention.

FIGS. 6A and 6B depict an embodiment of a receiving assembly 40. The receiving assembly 40 comprises a receiving base 42 and a receiving element 44. In this embodiment, the receiving assembly 40 is designed to couple around a non-hinged edge 17, see FIG. 5, of a swinging door 12. The receiving base 42 comprises a U shaped part, wherein a middle section 41 of the receiving base 42 is positioned on the non-hinged edge 17 of a swinging door 12 with interior and exterior side sections 43, 45 of the receiving base 42 being positioned flush on an interior side 18 and exterior side 19 of the swinging door 12, see FIG. 4. The receiving base 42 further comprises bend 51 which separates the middle section 41 from exterior side section 45 and allows the receiving base 42 to fit around the non hinged edge 17 of a swinging door 12. The receiving base 42 may further be formed from a flexible material which allows the user to reform the receiving base 42 and to adjust the placement of bend 51 in order to fit a variety of swinging door 12 thicknesses. Receiving base 42 may also be formed in a variety of sizes with bend 51 in a variety of placements in order to fit standard size doors. The receiving base 42 may further comprise mounting apertures 46 in various quantities and configurations, wherein the receiving base 42 may be coupled with the swinging door 12 using conventional fasteners. It is also contemplated that the receiving base 42 may be coupled with the swinging door 12 by use of an adhesive, compression force, and the like. In this embodiment, the receiving element 44 comprises material protruding substantially perpendicular to the opening direction of a swinging door 12. The receiving element 44 may be coupled to the receiving base portion on the interior side section 43 of the receiving base 42. The receiving element 44 is substantially flush with the middle section 41 of the receiving base 42, wherein an equipped swinging door 12 may close without interference, see FIG. 1.

While the depicted embodiments teach a receiving assembly 40 comprising the described receiving base 42, it is contemplated that the receiving assembly 40 may comprise a receiving base 42 of various forms, wherein a user may mount the receiving assembly 40 to either a fixed position member or a movable member of a door unit. In addition, it is contemplated that the receiving element 44 may be mounted without a receiving base 42.

Figure 4:
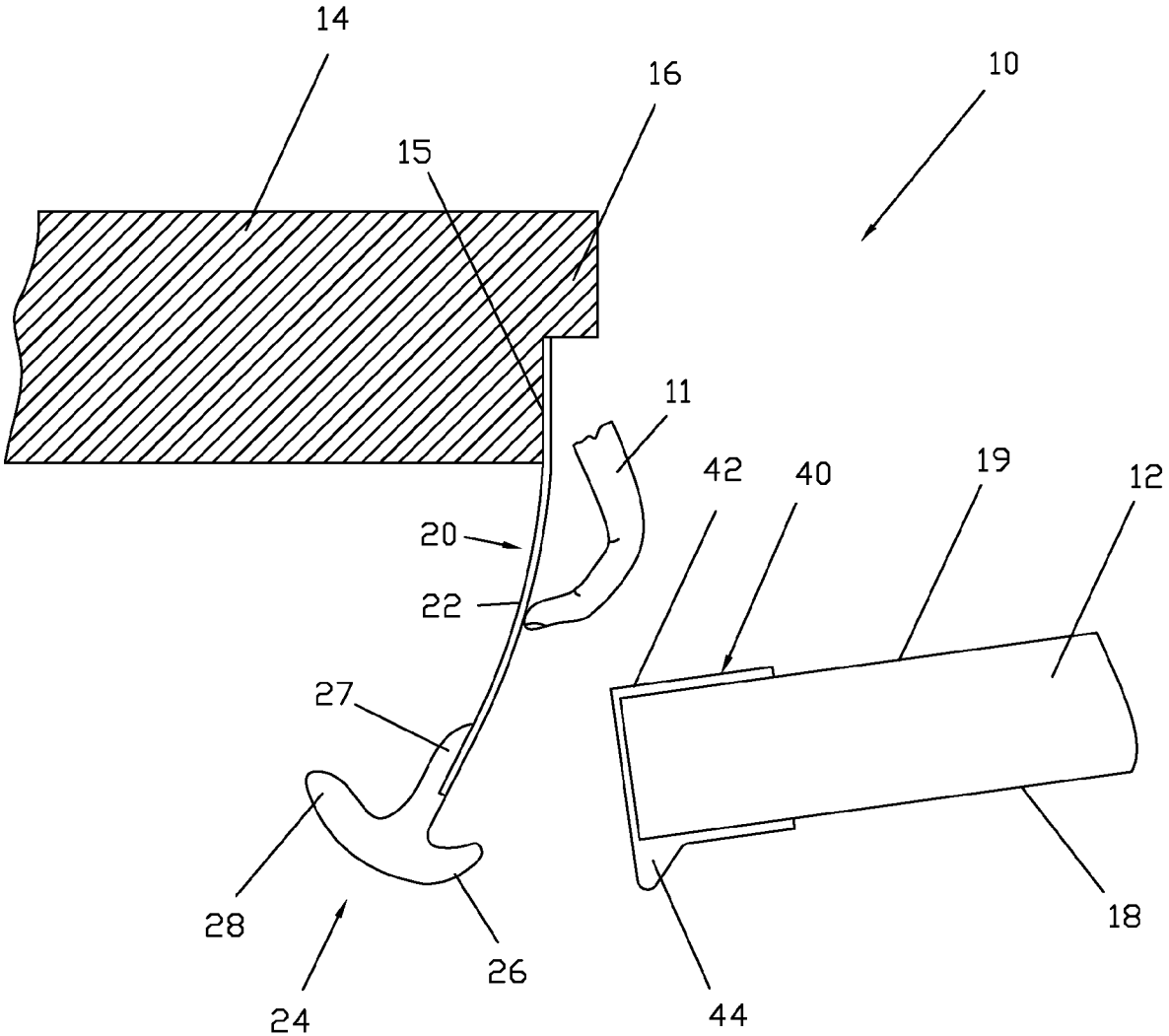
FIG. 4 is a sectional view taken along the line A-A of FIG. 2 of a safety latch apparatus configured according to an embodiment of the present invention coupled to a door unit, and depicting exterior user deflection of the latching assembly.
Figure 5:
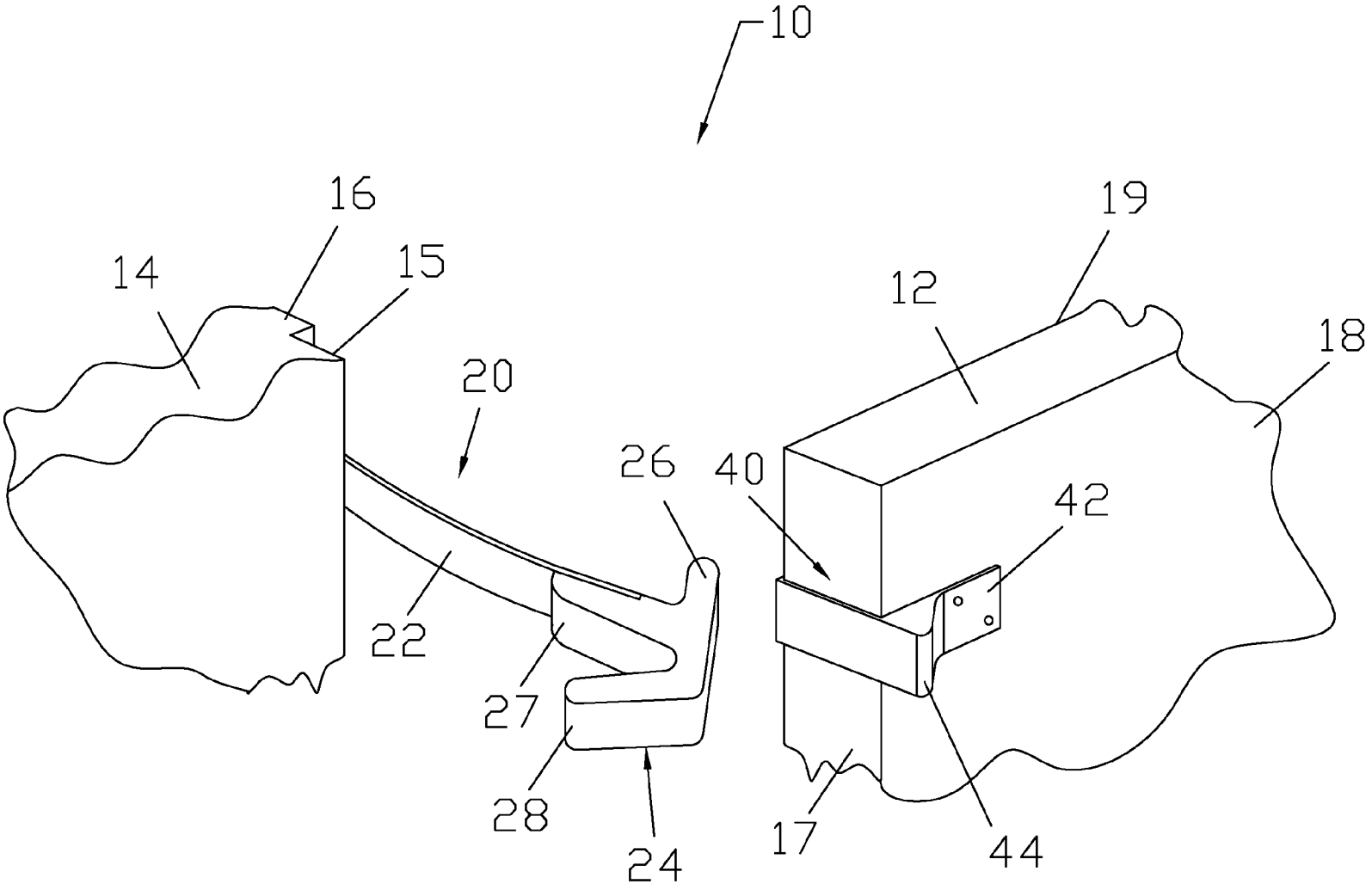
FIG. 5 is a perspective view of a safety latch apparatus configured according to an embodiment of the present invention coupled to an open door unit.
Figure 7:
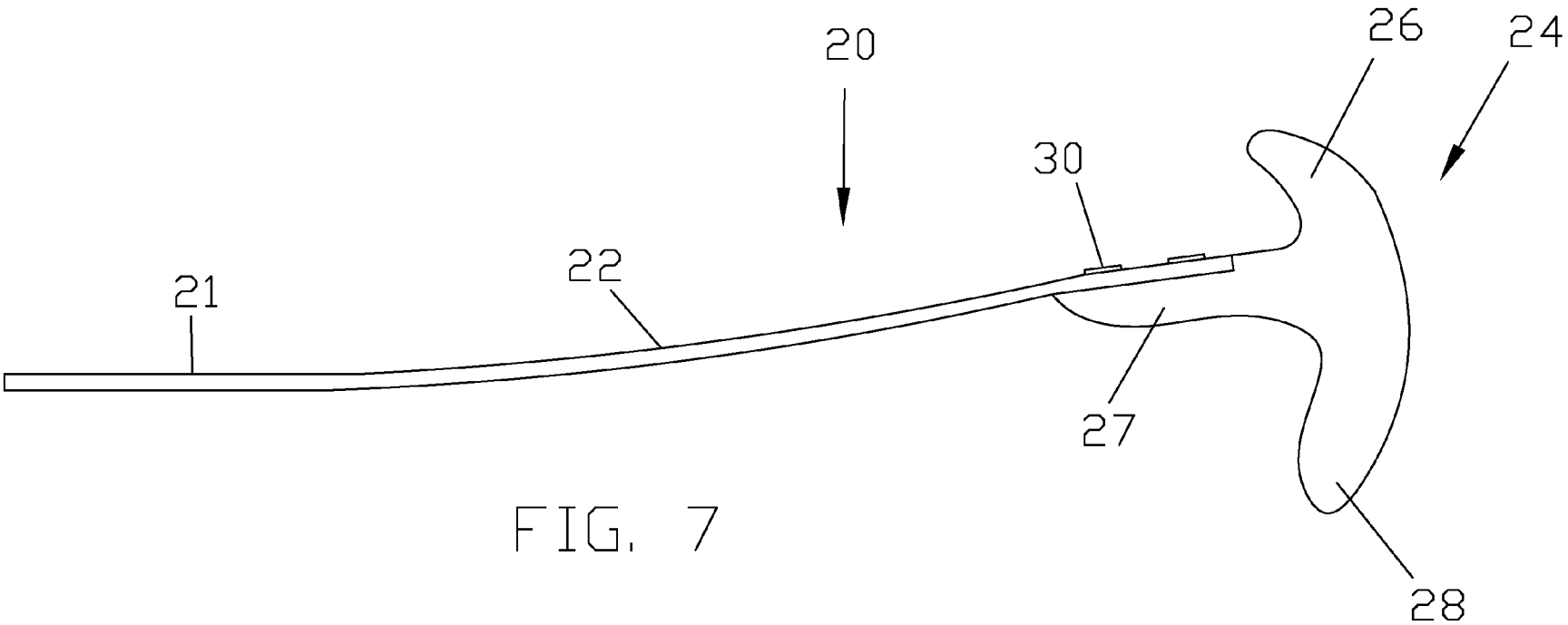
FIG. 7 is a top view of a latching assembly configured according to an embodiment of the present invention.

FIG. 7 depicts a latching assembly 20 configured according to an embodiment of the present invention. In this embodiment, the latching assembly 20 comprises a compliant arm 22, a catch element 24, and a latching assembly base portion 21. The compliant arm 22 may comprise a narrow strip of compliant material, such as, but not limited to, metals and plastics. The compliant arm 22 may also comprise a member of a variety of shapes including, but not limited to, a C shaped member, an I shaped member, or the like. In the depicted embodiment, the compliant arm 22 is a thin rectangular strip of material that is manufactured in a curved style wherein the curvature of the compliant arm 22 is substantially the same or greater than the curvature of an arc of a swinging door 12. The curvature of the compliant arm 22 functions to ensure latch engagement between the latching assembly 20 and receiving assembly 40. One end of the compliant arm 22 may function as the latching assembly base portion 21, wherein the latching assembly base portion 21 may comprise various quantities and configurations of countersunk apertures, holes or other attachment devices. The latching assembly base portion 21 of the compliant arm 22 maybe fastened, using conventional fasteners, to a door frame member 14 using the pre-cut countersunk apertures, holes or other attachment devices. The latching assembly base portion 21 may be mounted, as shown in FIG. 4, directly to the interior side 15 of the frame member 14 in front of the door jam 16.

On an opposing end of the compliant arm 22, a catch element 24 may be coupled. The catch element 24 may comprise a hook 26, a user interaction portion 28, and a compliant arm coupling portion 27. The compliant arm coupling portion 27 is a portion of the catch element 24 that is substantially the same width as the compliant arm 22 and has a flat area such that the flat area may be coupled with the end of the compliant arm 22 by using conventional fasteners such as screws 30, nails, adhesives, welding, or the like. The hook 26 may comprise a protrusion of material sufficient to engage with the receiving element 44, shown in FIG. 6B. The hook 26 may also be rounded in order to protect a user from being poked in the eye. The user interactive portion 28 may comprise a portion of material that may be coupled to the hook 26 in a plurality of shapes and sized such that a user may utilize the user interactive portion 28 to deflect the compliant arm 22. It is contemplated that the latching assembly 20, including the compliant arm 22, latching assembly base portion 21, and catch element 24 may be manufactured as one part.

While the depicted embodiments teach a latching assembly 20 comprising the described latching assembly base portion 21, it is contemplated that the latching assembly 20 may comprise a latching assembly base portion 21 of various forms, wherein a user may mount the latching assembly 20 to either a fixed position member or a movable member of a door unit.

FIGS. 1-5 depict various configurations of the embodiments depicted in FIGS. 6A, 6B, and 7 of a mounted safety latch apparatus 10. As shown, the latching assembly 20 and receiving assembly 40 may both couple to a hinged door unit. A hinged door unit comprises a movable door portion 12 and a fixed frame portion 14. In the depicted embodiment, the receiving assembly 40 is mounted near the top of a movable door portion 12 of a swinging door unit, and a latching assembly 20 is mounted on the corresponding fixed frame portion 14 of the same door unit at approximately the same vertical height as the mounted receiving assembly 40. It is contemplated that the latching assembly 20 and receiving assembly 40 may be mounted at any vertical position on a door unit, however in order to prevent children or pets from tampering with the safety latch apparatus 10, the safety latch apparatus 10 should be mounted at a sufficient vertical height on the door unit to prevent access by unauthorized agents.

Figure 2:
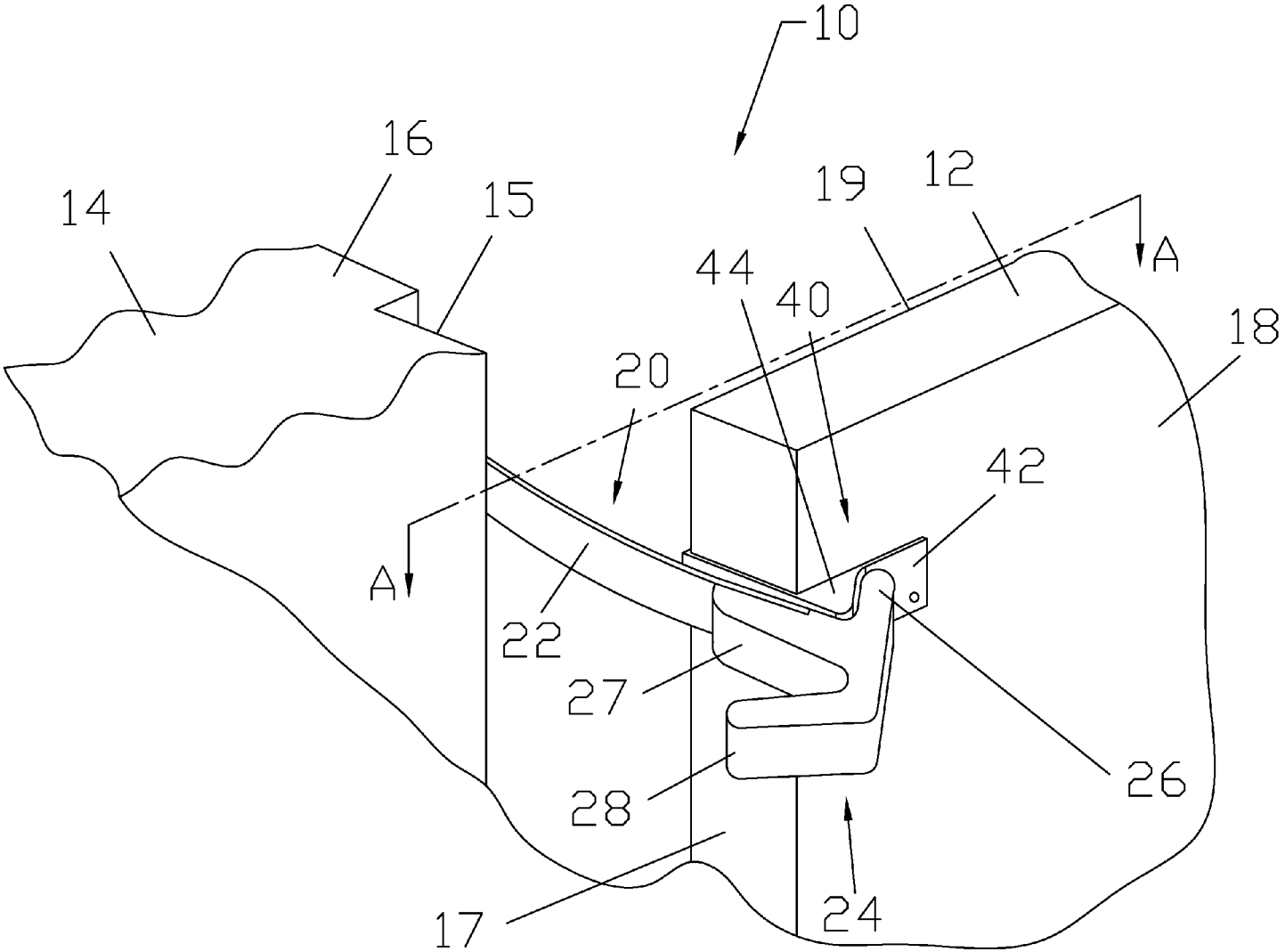
FIG. 2 is a perspective view of an engaged safety latch apparatus configured according to an embodiment of the present invention coupled to a partially open door unit.

FIG. 1 depicts a safety latch apparatus 10 mounted to a closed swinging door unit. Upon opening the swinging door 12, as shown in FIG. 2, the receiving element 44 of the receiving assembly 40 follows the arc of the opening door 12. Due to the curvature of the compliant arm 22, the receiving element 44 slides adjacent the compliant arm 22 until the hook 26 of the catch element 24 engages with the receiving element 44, wherein the movement of the door 12 is halted and the door 12 is prevented from opening further. It is contemplated that the compliant arm 22 may be manufactured in a variety of lengths such that a user can choose the distance a door 12 may be opened prior to latch engagement.

Figure 3:
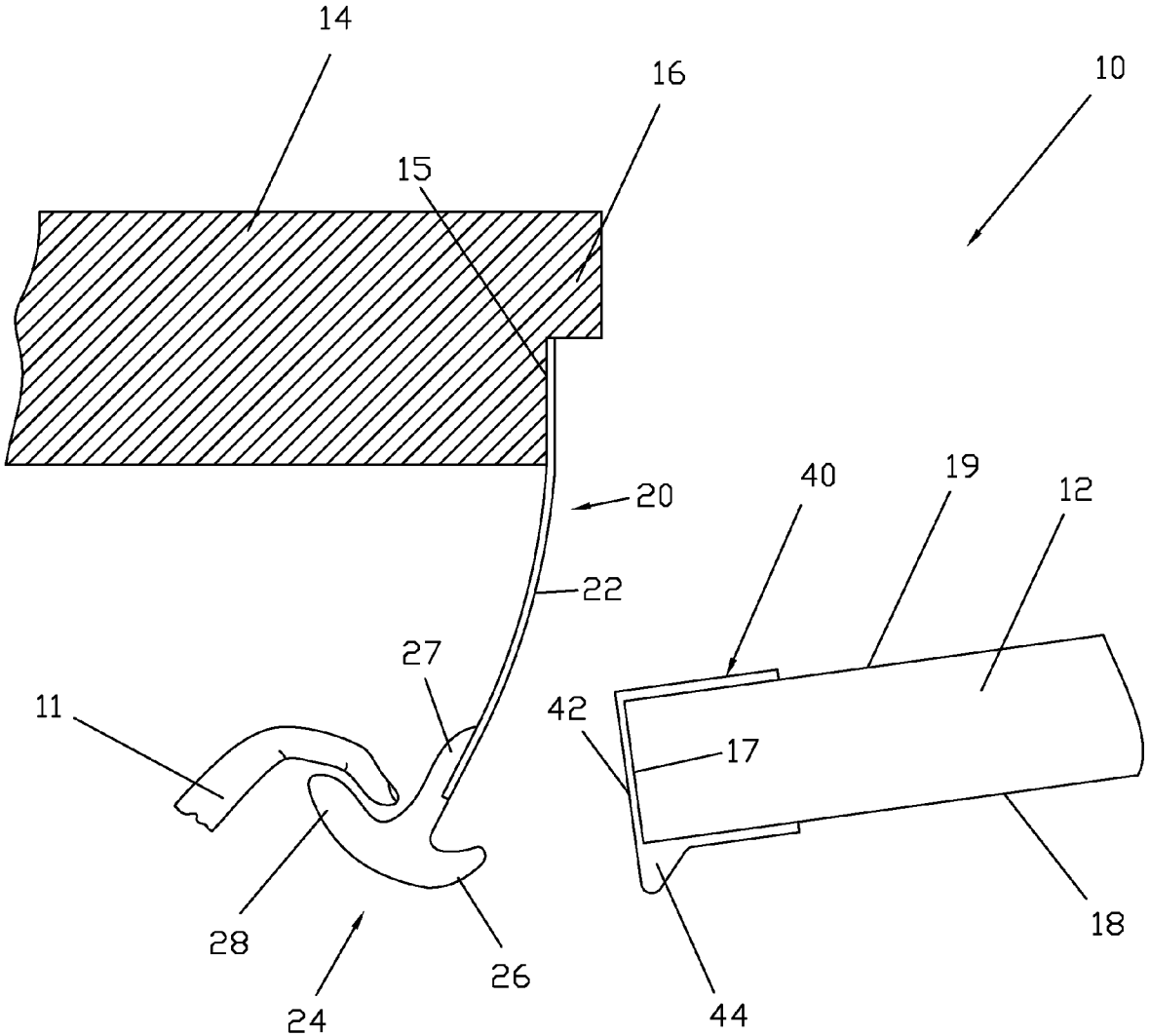
FIG. 3 is a sectional view taken along the line A-A of FIG. 2 of a safety latch apparatus configured according to an embodiment of the present invention coupled to a door unit, and depicting interior user deflection of the latching assembly.

FIG. 3 depicts a first of two manual overrides to the safety latch apparatus 10. The hatching in FIG. 3 is meant to be generic, as a fixed frame portion 14 of a door unit may be formed from a variety of materials including, but not limited to wood, metal, drywall, plastic, composites, and the like. If an authorized user is attempting to open a door 12 from the interior side 18, said user may use fingers 11 of a hand and exert a slight force away from the receiving element 44 on the user interactive portion 28 of the catch element 24. Such a force, directed away from the receiving element 44, will bend the compliant arm 22 and force the catch element 24 away from the receiving element 44. The user may then continue to open the door 12 and the safety latch apparatus 10 function will be bypassed, see FIG. 5. Upon releasing the catch element 24, the compliant arm 22 will return to its original curved path, such that a subsequent unauthorized person will cause engagement of the safety latch apparatus 10 upon opening the door 12.

FIG. 4 depicts a second of two manual overrides to the safety latch apparatus 10. The hatching in FIG. 4 is meant to be generic, as a fixed frame portion 14 of a door unit may be formed from a variety of materials including, but not limited to wood, metal, drywall, plastic, composites, and the like. If an authorized user is attempting to open a door 12 from the exterior side 19, said user may, after slightly opening the door 12 creating an opening, pass fingers 11 of a hand through the created opening and exert a slight force on the compliant arm 22 directed away from the receiving element 44. Such a force, directed away from the receiving element 44, will bend the compliant arm 22 and catch element 24 away from the receiving element 44. The user may then continue to open the door 12 and bypass latch 10 engagement, see FIG. 5. Upon releasing the compliant arm 22, after preventing latch engagement, the compliant arm 22 will return to its original curved path, such that a subsequent unauthorized person will cause engagement of the safety latch apparatus 10 upon opening the door 12.

In other embodiments, latching assembly 20 may be mounted on the movable door portion 12 of a hinged door unit, and the receiving assembly 40 may be mounted on the corresponding fixed frame portion 14 of the same door unit. In these embodiments the latching assembly 20 will move with the swinging door and the receiving assembly 40 will be fixed on the frame portion of a door unit. Both types of manual overrides will be available to a user in these embodiments.

Figure 10C:
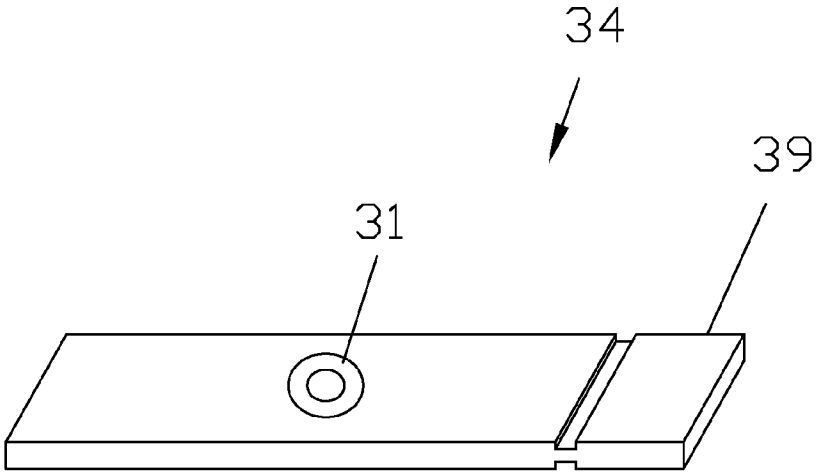
FIG. 10C is a perspective view of a compliant arm cover plate configured according to an embodiment of the present invention.
Figure 10A:
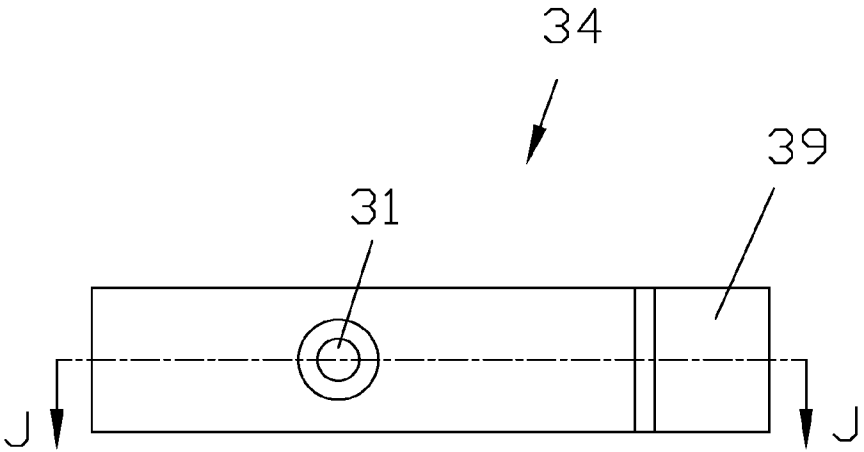
FIG. 10A is a top view of a compliant arm cover plate configured according to an embodiment of the present invention.
Figure 10B:
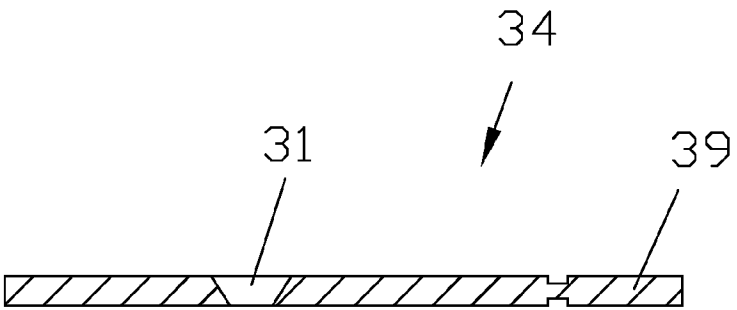
FIG. 10B is a sectional view of FIG. 10A along the line J-J, and depicting a compliant arm cover plate configured according to an embodiment of the present invention.

FIGS. 8A-10C depict an embodiment of a latching assembly mounting mechanism 50 that may allow a user another avenue for disengaging the safety latch functionality quickly and easily. The depicted latching assembly mounting mechanism 50 comprises an arm retaining plate 32 and an arm cover plate 34. The arm retaining plate 32, as depicted in FIGS. 9A-9C, may comprise a thin rectangular piece of material comprising a plurality of frame mounting apertures 33 or the like, a compliant arm positioning head 37, and an arm coupling aperture 35. The compliant arm positioning head 37 may be a bump extending from the arm retaining plate 32, a pin, an indentation, a groove or the like. In alternate embodiments, the arm retaining plate 32 may comprise multiple arm coupling apertures 35, multiple threaded apertures, at least one aperture and a compliant arm positioning head 37 or the like. The arm cover plate 34, as depicted in FIGS. 10A-10C, may comprise a thin rectangular piece of material comprising one or a plurality of arm coupling apertures 31, and/or one or a plurality of removable frame extending portions 39. The hatching in FIGS. 8B, 9B, 10B is meant to be generic, as the arm retaining plate 32, the arm cover plate 34, the compliant arm 22, and conventional fasteners 36, 38 may be formed from a variety of materials including, but not limited to woods, metals, plastics, composites, and the like. The arm retaining plate 32 and the arm cover plate 34 may also be round, triangular, hexagonal or any shape which would perform the required purpose.

Installation of the latching assembly mounting mechanism 50 may require a portion of frame 14 material to be removed, wherein the latching assembly mounting mechanism 50 would not obstruct the area occupied by a closed door 12. Initially, as shown in cutaways C and F of FIG. 8B, the arm retaining plate 32 may be fixedly coupled to a fixed frame member by use of conventional fasteners 36 such as nails, screws, adhesives or the like. The arm retaining plate 32 may be coupled with conventional fasteners 36 utilizing the frame mounting apertures 33. Conventional fasteners 36 may be selected such that an installed arm retaining plate 32 with installed fasteners 36 would be substantially flat at the fastener locations. After installation of the arm retaining plate 32, the end of a compliant arm 22 would couple with the arm retaining plate 32 utilizing the compliant arm positioning head 37. In this embodiment, the end of the compliant arm 22 comprises a female aperture 47 for receiving the male compliant arm positioning head 37. This mating, shown in cutaway D of FIG. 8B assists in aligning the compliant arm 22 on the arm retaining plate 32. The end of the compliant arm 22 may also comprise one or a plurality of threaded apertures 48 of the same diameter and thread type as the threaded arm coupling aperture 35 of the compliant arm retaining plate 32. In embodiments not comprising a compliant arm positioning head 37, the compliant arm 22 and the arm retaining plate 32 may be aligned using other methods.

Figure 8A:
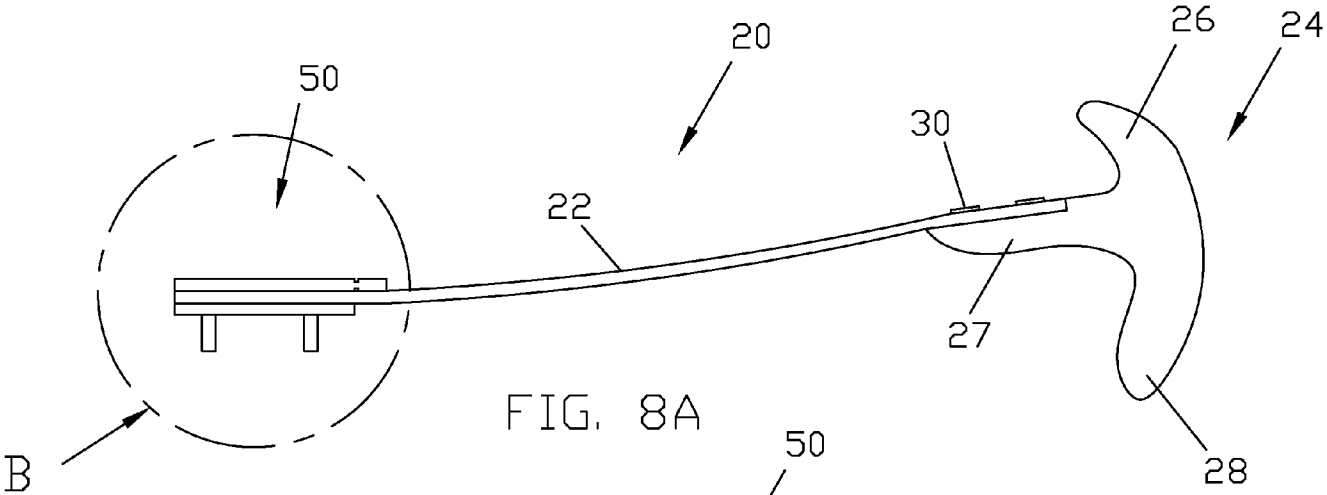
FIG. 8A is a top view of a latching assembly with latching assembly mounting mechanism configured according to an embodiment of the present invention.
Figure 8B:
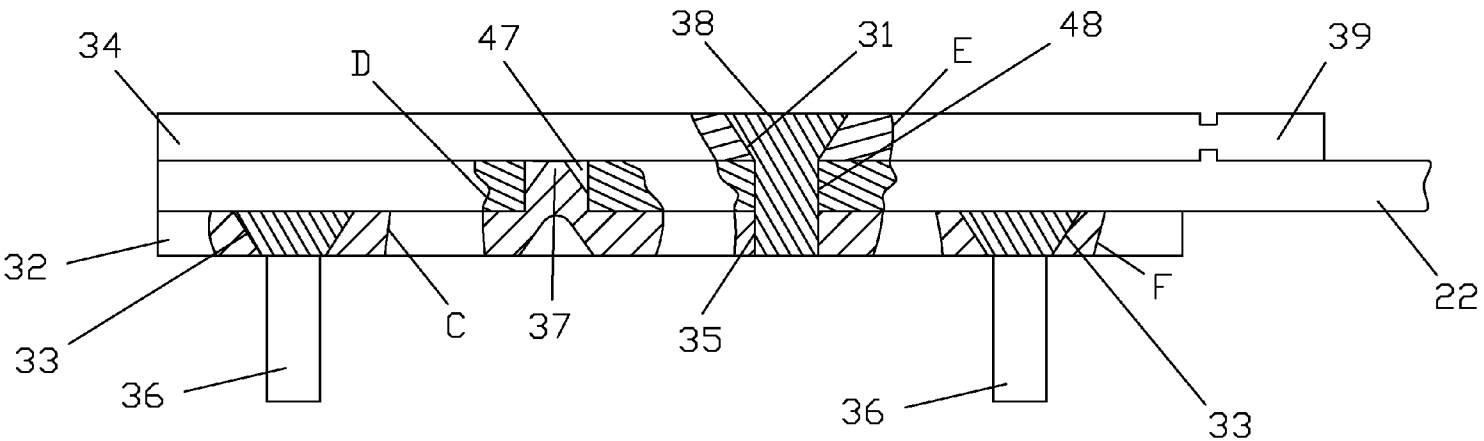
FIG. 8B is a enlarged view of the area enclosed by line B of FIG. 8A depicting a latching assembly mounting mechanism configured according to an embodiment of the present invention.
Figure 9C:
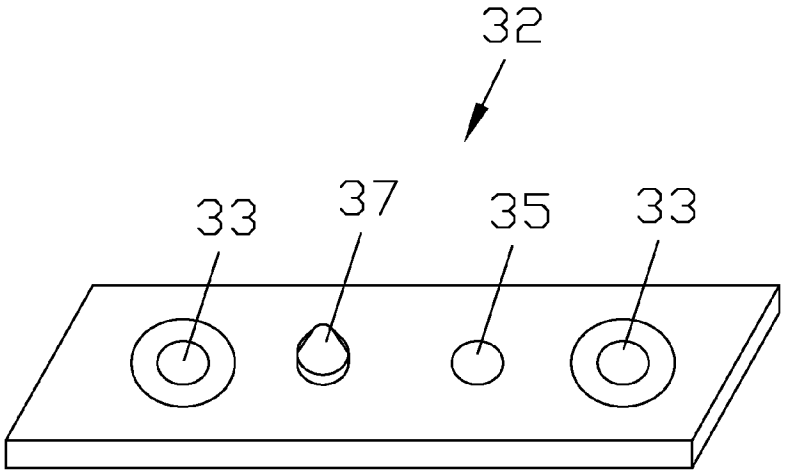
FIG. 9C is a perspective view of a compliant arm retaining plate configured according to an embodiment of the present invention.
Figure 9A:
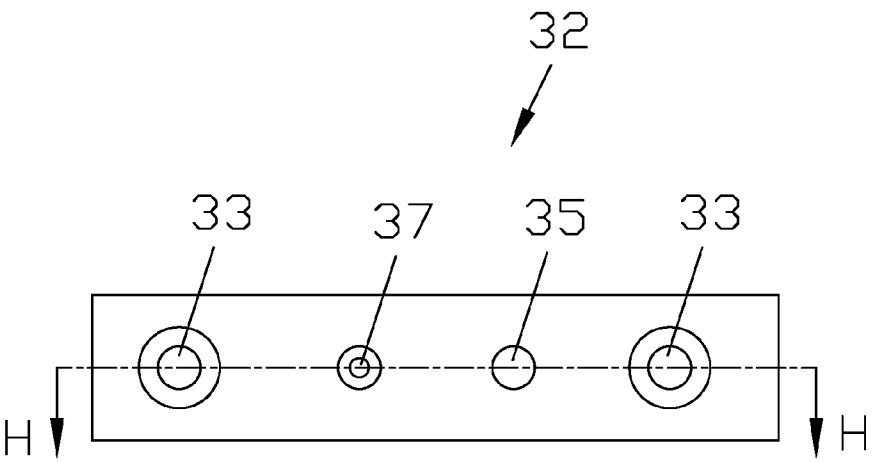
FIG. 9A is a top view of a compliant arm retaining plate configured according to an embodiment of the present invention.
Figure 9B:
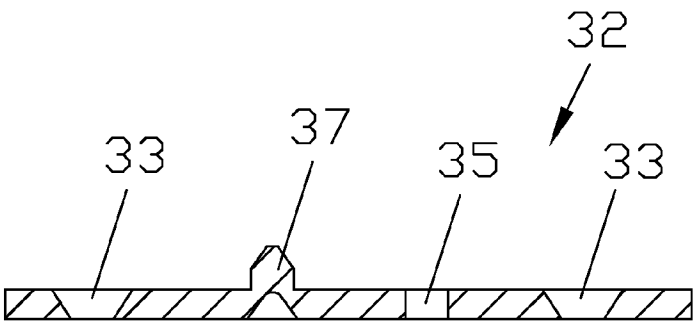
FIG. 9B is a sectional view of FIG. 9A along the line H-H, and depicting a compliant arm retaining plate configured according to an embodiment of the present invention.

Finally, the arm cover plate 34 may be placed adjacent to the end of the compliant arm 22 and a conventional threaded fastener 38 may be inserted into an arm coupling aperture 31 in the arm cover plate 34 and used to fasten the arm cover plate 34, the compliant arm 22, and the arm retaining plate 32 together, shown in cutaway E of FIG. 8B. The removable frame extending portions 39 comprise portions of the arm cover plate 34 that may be removed in order to account for varying sizes of door frames, in particular to varying lengths of the interior side 15 of a door frame 14 in front of the door jam 16, see FIG. 4. If the door frame is large then there may be no need to remove any removable frame extending portions 39, however, if the door frame is small there may exist a need to removed one or several removable frame extending portions 39. The depicted embodiment shows only one removable frame extending portion 39, however, it is contemplated that this invention may be manufactured with multiple removable frame extending portions 39. Each removable frame extending portion 39 may comprise a part of the arm cover plate 34 that has been partitioned for ease of removal of the removable frame extending portion 39.

Using this latching assembly mounting mechanism 50 configuration, a user may elect to permanently or temporarily remove the latching assembly 20 simply by removing the convention threaded fastener 38, the cover plate 34, and the latching assembly 20. Removal may simply require the removal of the conventional threaded fastener 38 and a user can then remove the entire latching apparatus 20. Reinstallation is fast and easy due to the existence of the compliant arm retaining plate 32 previously installed. This feature makes it simple and easy for a user to remove, replace, or adjust the latching assembly 20. It is also contemplated that a safety latch apparatus 10 comprising a latching assembly mounting mechanism 50 may also allow a user to simply couple the latching assembly 20 to a fixed position member of movable member of a door unit without mounting the entire latching assembly mounting mechanism 50. A user may choose to install the latching assembly 20 by fastening the compliant arm 22 directly to a frame 14 or door 12 member by using pre-cut apertures 47, 48 in the compliant arm 22.

Additionally, the invention, as configured in this embodiment, as well as other embodiments, will function to transfer tension forces in the compliant arm 22 caused by latch engagement, to shear forces exerted on the frame member 14 where the mounting mechanism 50 is coupled. The frame member 14 will be able to withstand higher shear forces before failure than a frame member 14 or wall member that experiences forces directed at stripping out the fasteners of a mounted latching mechanism 20.

Figure 11:
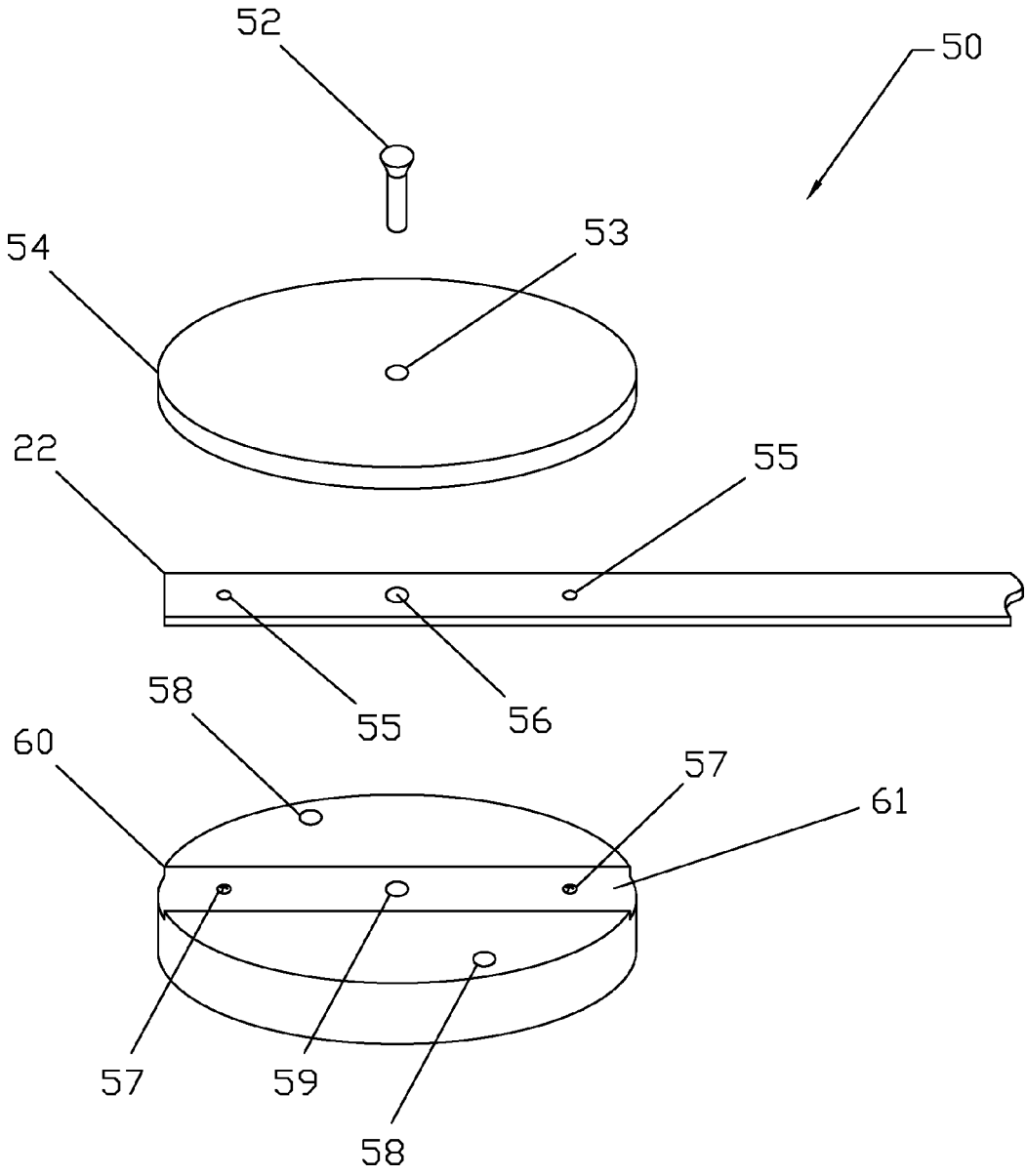
FIG. 11 is an exploded isometric view of a latching assembly mounting mechanism configured according to an embodiment of the present invention.

FIG. 11 depicts an alternate embodiment of a latching assembly mounting mechanism 50 configured according to an embodiment of the present invention. The depicted latching assembly mounting mechanism 50 comprises an arm retaining plate 60. The arm retaining plate 60 in this embodiment is a circular, substantially flat piece of material, however the arm retaining plate 60 may be formed in any shape desired. The arm retaining plate 60 further comprises a channel 61. The channel 61 comprises an indentation running the diameter of the arm retaining plate 60. The channel 61 may run the entire diameter of the arm retaining plate 60 or it may only run part of the diameter of the arm retaining plate 60. The channel 61 receives the compliant arm 22 when the latching assembly mounting mechanism 50 is used to mount the latching assembly.

The arm retaining plate 60 also comprises at least one frame mounting aperture 58. The at least one frame mounting aperture 58 allows the arm retaining plate 60 to be mounted to a door frame. The at least one frame mounting aperture 58 may receive any type of attachment device such as a bolt, screw, nail or the like which passes through the at least one frame mounting aperture 58 and into a door frame in order to mount the arm retaining plate 60 to the door frame. The arm retaining plate 60 may also be attached to a door frame by adhesive or the like and therefore the at least one frame mounting aperture 58 may not be needed.

At least one arm coupling aperture 59 may also be included in the arm retaining plate 60. The at least one arm coupling aperture 59 is located in the channel 61. Also located in the channel 61 may be a plurality of alignment heads 57. The plurality of alignment heads 57 are raised portions extending from the arm retaining plate 60. The plurality of alignment heads 57 may be formed by bumps in the arm retaining plate 60, pins extending from the arm retaining plate 60, rivet heads extending from the arm retaining plate 60 or the like.

In order for the compliant arm 22 to mate with the latching assembly mounting mechanism 50 depicted in this embodiment, the compliant arm 22 may comprise at least one arm coupling aperture 56 and also a plurality of alignment apertures 55.

The latching assembly mounting mechanism 50 of this embodiment further comprises an arm cover plate 54. The arm cover plate 54 depicted in this embodiment is a flat, circular piece of material, however the arm cover plate 54 may be any shape desired. The arm cover plate 54 comprises at least one arm coupling aperture 53.

After the arm retaining plate 60 of this embodiment is mounted to the door frame, the compliant arm 22 is placed in the channel 61 on the arm retaining plate 60. The channel 61 prevents the compliant arm 22 from twisting. The plurality of alignment apertures 55 on the compliant arm 22 are also mated with the plurality of alignment heads 57 on the arm retaining plate 60. The plurality of alignment heads 57 extend into the plurality of alignment apertures 55 preventing the compliant arm 22 from moving, twisting or the like.

In other embodiments the plurality of alignment heads 57 on the arm retaining plate 60 may be replaced with apertures. The apertures are used to receive securing devices such as screws, bolts, tacks, pins or the like which would pass through the plurality of alignment apertures 55 on the compliant arm 22 and into the plurality of apertures replacing the plurality of alignment heads 57 on the arm retaining plate 60.

In still other embodiments, the plurality of alignment heads 57 on the arm retaining plate 60 may be replaced with a plurality of apertures while the plurality of alignment apertures 55 on the compliant arm 22 may be replaced with a plurality of alignment heads. The plurality of alignment heads on the compliant arm 22 would then mate with the plurality of alignment apertures on the arm retaining plate 60.

Once the compliant arm 22 is in place in the channel 61, the arm cover plate 54 is placed over the arm retaining plate 60 and an attachment device 52 is placed through the at least one arm coupling aperture 53 on the arm cover plate 54. The attachment device 52 also passes through the at least one arm coupling aperture 56 on the compliant arm 22 and into the at least one arm coupling aperture 59 on the arm retaining plate 60. The attachment device 52 may be a screw, bolt, pin, tack, nail or the like.

Once the latching assembly has been mounted utilizing this embodiment of a latching assembly mounting mechanism 50, the latching assembly may be removed from the door frame by removing the attachment device 52 and then removing the compliant arm 22 from the pins, tacks or the like placed in the plurality of alignment apertures 55.

The plurality of alignment apertures 55 on the compliant arm 22 may also be used to mount the compliant arm 22 directly to a door frame. The compliant arm 22 is simply held in place against the door frame and pins, tacks, screws, bolts, nails or the like are placed through the plurality of alignment apertures 55 and into the door frame.

Figure 12:
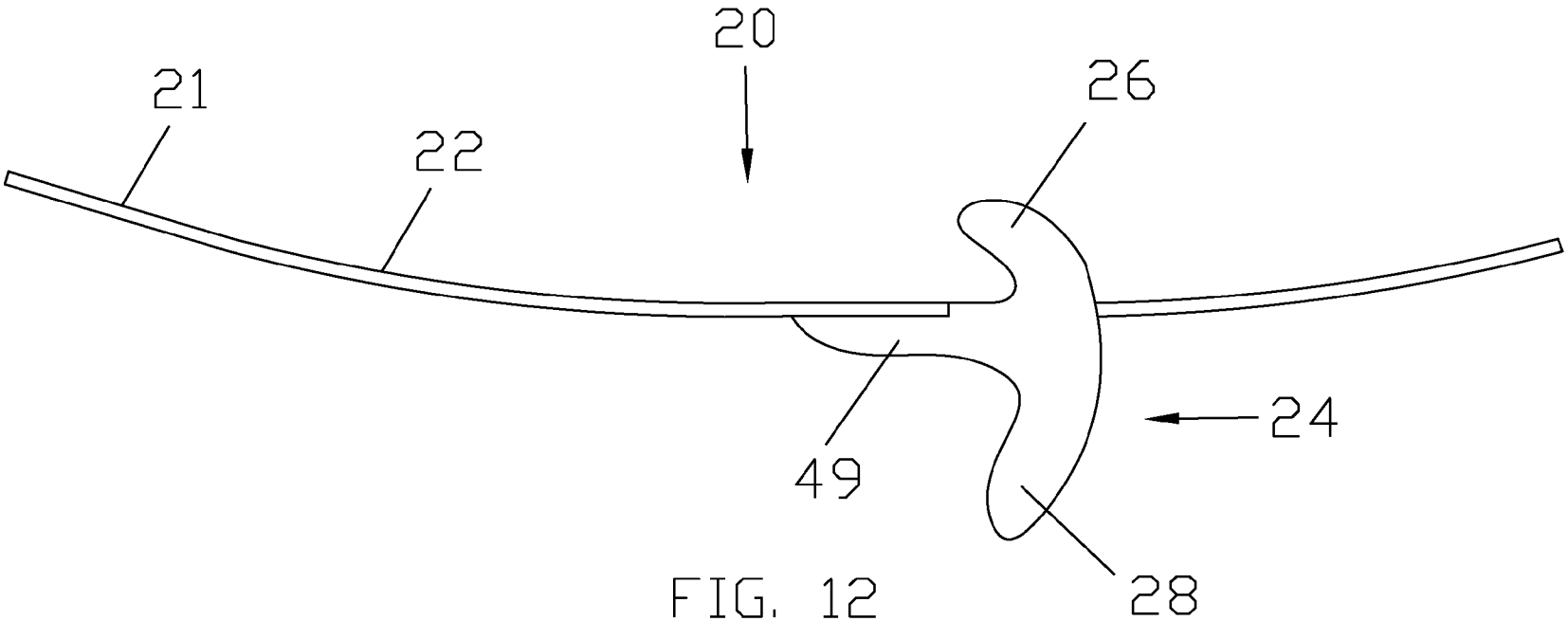
FIG. 12 is a top view of an adjustable latching assembly configured according to an embodiment of the present invention with the catch element positioned near a middle of a compliant arm.
Figure 13:
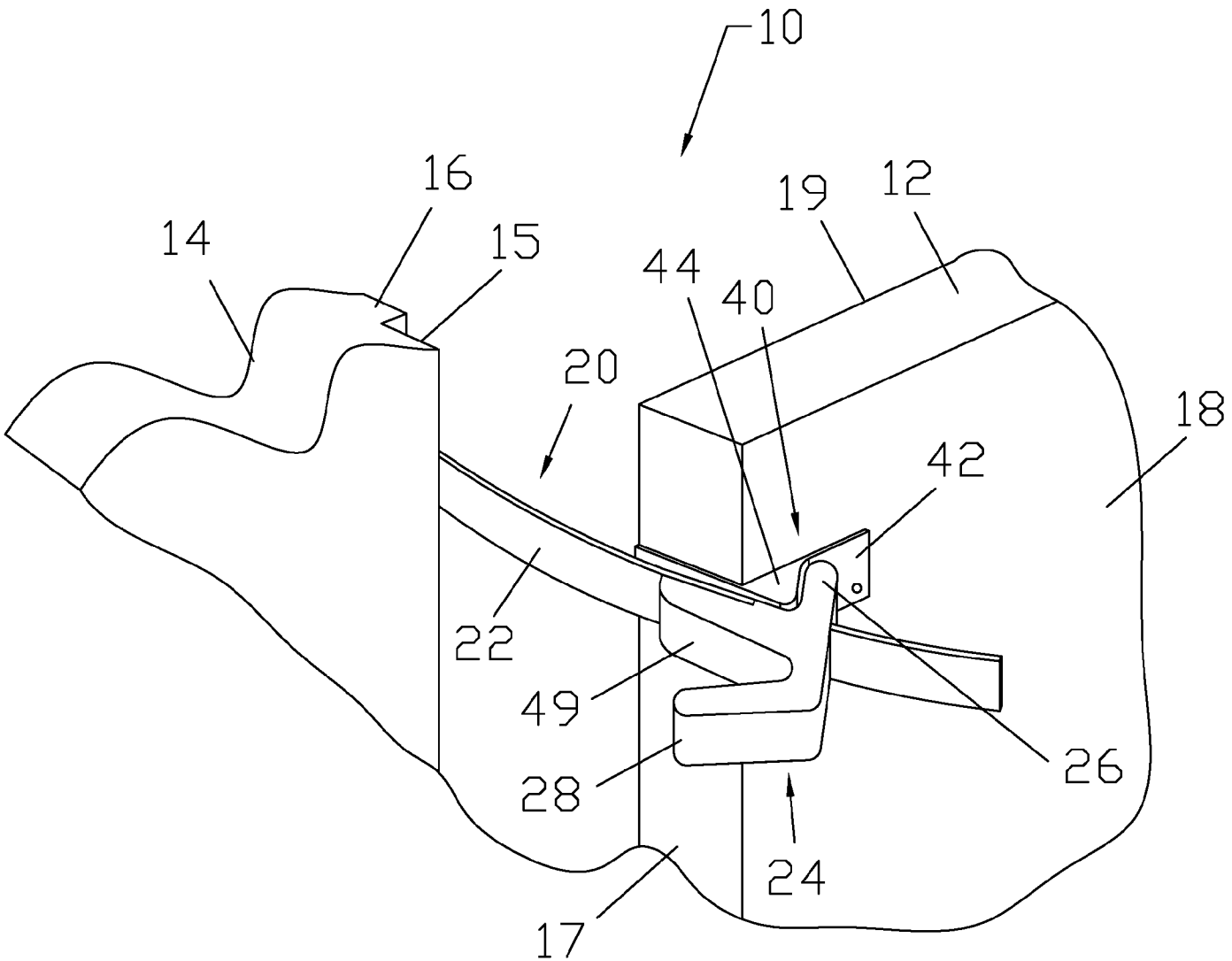
FIG. 13 is a perspective view of an engaged safety latch apparatus configured according to an embodiment of the present invention coupled to a door unit with a catch element of an adjustable latching assembly positioned near a middle of a compliant arm.

FIGS. 12-13 depict an alternate embodiment of the latching assembly 20. In this embodiment the catch element 24 of the latching assembly 20 is slideable and lockable on the compliant arm 22 by use of a release/locking mechanism 49, such that the arc distance a swinging door 12 may open prior to engagement of said catch element 24 and receiving element 44 is adjustable. In this embodiment, a person occupying the interior of a room with a swinging door 12 equipped with an adjustable safety latch assembly 10 may choose, with the swinging door 12 in the closed position, to release the release/locking mechanism 49, slide the catch element 24 down the entire shaft of the compliant arm 22, and lock the release/locking mechanism 49, wherein the door 12 may not be opened any distance. In this configuration the safety latch assembly 10 would function as a door lock thereby providing privacy to the room. The catch element 24 may, at any time, be slid the opposite direction to disengage the locking feature of the safety latch assembly 10.

Additionally, a user may, by sliding the catch element 24 along the compliant arm 22, select an arc distance that a door 12 will open prior to latch engagement. For example, a homeowner in possession of a small cat may desire to prevent the feline from entering a given room. The homeowner may set the safety latch apparatus 10 to a distance so that the feline may not pass through, but large enough for an authorized user to disengage the safety latch apparatus 10 from the exterior side 19 of a swinging door 12. The adjustable latching element 20 comprises a locking feature, wherein a user may select a location on the compliant arm 22 for the catch element 24 and then lock the catch element 24 in that selected position. Upon locking of the catch element 24, the safety latch would be fully functional to prevent access to the room.

Additionally, in this embodiment the catch element 24 may be slid and removed entirely from the compliant arm 22, thereby disengaging the latching function of the safety latch apparatus 10 altogether. This feature would allow a user to quickly and easily disengage the latching function for a temporary or extended period of time. Subsequently, when the need arises, the user may slide the catch element 24 back on the compliant arm 22 and continue to utilize the safety latch apparatus 10.

Figure 14:
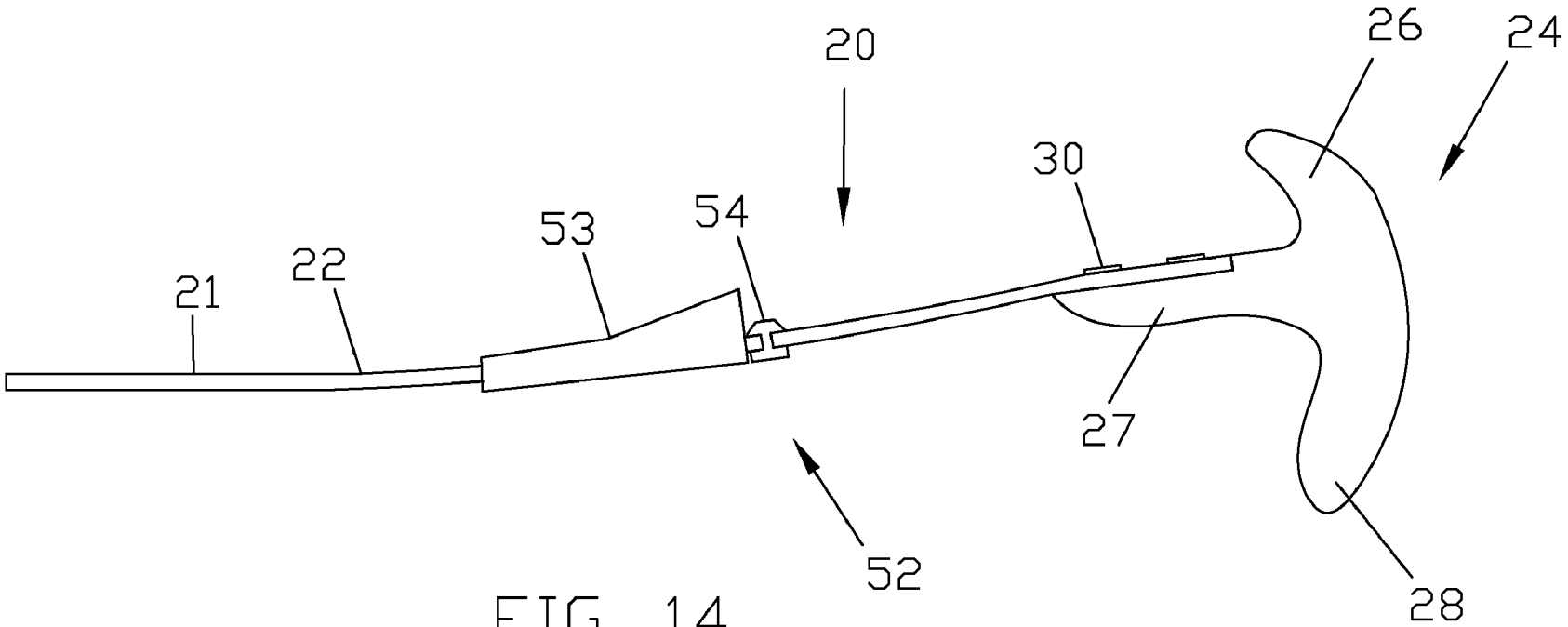
FIG. 14 is a top view of a latching assembly including a finger protector configured according to an embodiment of the present invention.

FIG. 14 illustrates an alternate embodiment of a latching assembly 20 further comprising a finger protector 52. A finger protector 52 configured according to an embodiment of the present invention comprises a protector 53 and a stop 54. The protector 53 may comprise a wedge shaped piece of material which attaches to the compliant arm 22. The bulk of the material in the wedge is positioned on the opposite side of the compliant arm 22 as the user interactive portion 28. The protector 53 may attach to the compliant arm 22 by sliding or snapping onto the complaint arm 22 or the like. The finger protector 52 may further comprise a stop 54. The stop 54 prevents the protector 53 from sliding along the compliant arm 22. The stop 54 may be a device which attaches to the compliant arm 22 and is removable or movable, or it may be a bump or the like which is permanently attached to the compliant arm 22. More than one stop 54 may be used in order to prevent the protector 53 from moving. The protector 53 may also be permanently attached to the compliant arm 22 or may be attached in such a way that a stop 54 is not needed. When a door, which the safety latch apparatus is coupled to, is closed, the finger protector 52 prevents the door from closing far enough for the fingers of a child, the infirmed or the like from being smashed in the door, while the safety latch apparatus prevents the door from being opened enough for the child to pass through. The finger protector 52 may be formed in any shape which would prevent a door from closing completely and smashing the fingers of a child, the infirmed or the like in the door.

Alternate embodiments of the present invention may couple the safety latch apparatus with a spring hinge or auto-closing mechanism coupled to the door. This embodiment would help to assure that the door would return closed and that the safety latch would reengage after a user had passed through the door.

Accordingly, for the exemplary purposes of this disclosure, the components defining any embodiment of the invention may be formed as one piece if it is possible for the components to still serve their function. The components may also be composed of any of many different types of materials or combinations thereof that can readily be formed into shaped objects provided that the components selected are consistent with the intended mechanical operation of the invention. For example, the components may be formed of rubbers (synthetic and/or natural), glasses, composites such as fiberglass, carbon-fiber and/or other like materials, polymers such as plastic, polycarbonate, PVC plastic, ABS plastic, polystyrene, polypropylene, acrylic, nylon, phenolic, any combination thereof, and/or other like materials, metals, such as zinc, magnesium, titanium, copper, iron, steel, stainless steel, any combination thereof, and/or other like materials, alloys, such as aluminum, and/or other like materials, any other suitable material, and/or any combination thereof.

The embodiments and examples set forth herein were presented in order to best explain the present invention and its practical applications and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims. Accordingly, any components of the present invention indicated in the drawings or herein are given as an example of possible components and not as a limitation.

The invention claimed is:

1. A safety latch apparatus for retaining a movable member of an opening assembly in a closed or substantially closed position relative to a fixed position member of an opening assembly, said opening assembly having a fixed position member and a movable member, said safety latch apparatus comprising:

a receiving assembly having a base portion for mounting to said fixed position member or said movable member and a single receiving element protruding from said base portion; and a latching assembly engageable with said receiving element, said latching assembly comprising:

an arm comprised of compliant material and having a separate hook element coupled at the end thereof, said biased compliant arm biasing said hook element towards said receiving element, wherein said receiving element engages said hook element;

a latching assembly mounting mechanism for mounting said biased compliant arm to said fixed position member or movable member such that the receiving assembly and latching assembly are mounted on cooperating fixed position member and movable member, said latching assembly mounting mechanism further comprising an arm retaining plate coupled to said fixed position member or said movable member and also coupled to said biased compliant arm, and said latching assembly mounting mechanism comprising an arm cover plate removably coupled to said biased compliant arm, wherein the arm cover plate has a contacting surface with the biased compliant arm; and a means for disassembling said latching assembly mounting mechanism while leaving the arm retaining plate coupled to said fixed position member or said movable member and removing said arm cover plate and said biased compliant arm in order to allow said opening assembly to freely open.

2. The apparatus of claim 1, wherein the biased compliant arm is curved to predispose said hook catching element towards said receiving element to facilitate engagement with said receiving element.

3. The apparatus of claim 1, wherein said catch element and said receiving element engage at a single point.

4. The apparatus of claim 1, wherein the arm cover plate further comprises removable sections wherein removal of removable sections facilitate proper fit on a door frame.

5. A safety latch apparatus for retaining a swinging door in a closed or substantially closed position relative to a door frame in a door unit, said door unit having a first fixed member and a second movable member, said safety latch comprising:

a receiving assembly having a base portion for mounting to said first fixed position member or said second movable member and a single receiving element protruding from said base portion; and a latching assembly engageable with said receiving element, said latching assembly comprising:

a curved compliant arm wherein the curvature of the arm is substantially the same or greater than a curvature of the arc of the swinging door;

a separate catch element coupled at the end of the compliant arm, wherein said curved compliant arm biases said catch element towards said receiving element to facilitate engagement with said receiving element upon movement of said catch element and said receiving element towards each other;

a latching assembly mounting mechanism for mounting said curved compliant arm to said first fixed position member or said second movable member such that the receiving assembly and latching assembly are mounted on cooperating first fixed position and second movable members, said latching assembly mounting mechanism further comprising an arm retaining plate coupled to said fixed position member or said movable member and also coupled to said curved compliant arm, wherein the arm retaining plate further comprises a channel and at least one alignment head located in said channel, and wherein said curved compliant arm is placed in said channel and couples to said at least one alignment head, wherein said at least one alignment head prevents said curved compliant arm from rotating, said latching assembly mounting mechanism further comprising an arm cover plate removably coupled to said curved compliant arm, and wherein the arm cover plate has a contacting surface with said curved compliant arm; and a means for disassembling said latching assembly mounting mechanism while leaving the arm retaining plate coupled to said fixed position member or said movable member and removing said arm cover plate and said curved compliant arm in order to allow said swinging door to freely open.

6. The apparatus of claim 5, wherein the catch element of the latching assembly is slideable and lockable on the compliant arm.

7. The apparatus of claim 5, further comprising a finger protector.

8. The apparatus of claim 5, wherein the catch element comprises, a hook for engaging said receiving element at a single point when said receiving element and said catch element are moved toward each other.

9. The apparatus of claim 5, wherein the latching assembly base portion comprises a mounting mechanism, wherein the compliant arm may be removably coupled to the mounting mechanism.

10. The apparatus of claim 9, wherein the mounting mechanism is mounted, such that an engaged safety latch device transfers forces in shear to the door frame.

11. The apparatus of claim 5, wherein the catch element comprises a user interactive portion for deflecting the compliant arm away from the receiving element.

12. A safety latch apparatus for retaining a swinging door in a closed or substantially closed position relative to a door frame in a door unit, said door unit having a first fixed position member and a second movable member, said safety latch comprising:

a receiving assembly having a base portion for mounting to said first fixed position member or said second movable member and a single receiving element protruding from said base portion; and a latching assembly engageable with said receiving element, said latching assembly comprising:

a compliant arm having a separate catch element coupled at the end of the compliant arm, wherein said catch element and said receiving element engage each other at a single point when said swinging door is in a closed or substantially closed position;

a latching assembly mounting mechanism for mounting said compliant arm to said first fixed position member or said second movable member such that the receiving assembly and latching assembly are mounted on cooperating first fixed position and second movable members, said latching assembly mounting mechanism further comprising an arm retaining plate coupled to said fixed position member or said movable member and also coupled to said compliant arm, said latching assembly mounting mechanism further comprising an arm cover plate removably coupled to said compliant arm, and wherein the arm cover plate has a contacting surface with said compliant arm;

a means for disassembling said latching assembly mounting mechanism while leaving the arm retaining plate coupled to said fixed position member or said movable member and removing said arm cover plate and said compliant arm in order to allow said swinging door to freely open; and a means for reassembling said latching assembly mounting mechanism in order to once again restrict motion of the swinging door.

13. The apparatus of claim 12, wherein said latching assembly comprises a curved compliant arm such that a curvature of the arm is substantially the same or greater than a curvature of the arc of the swinging door.

14. The apparatus of claim 12, wherein the compliant arm is biased to predispose said catch element towards said receiving element to facilitate engagement with said receiving element.

15. The apparatus of claim 12, wherein the catch element of the latching assembly is slideable and lockable on the compliant arm.

16. The apparatus of claim 12, wherein the catch element of the latching assembly is removable from the compliant arm.

17. The apparatus of claim 12, wherein the catch element comprises a user interactive portion for deflecting the compliant arm away from said receiving element.

18. The apparatus of claim 12, wherein the latching assembly base portion comprises a mounting mechanism, wherein the compliant arm is removably coupled to the mounting mechanism.

19. The apparatus of claim 12, wherein the receiving element bends to fit swinging doors of different thicknesses.

20. The apparatus of claim 19, further comprising a finger protector.

* * * * *